US007000508B2

(12) United States Patent
Li et al.

(10) Patent No.: US 7,000,508 B2
(45) Date of Patent: Feb. 21, 2006

(54) DEVICE FOR NUMERICALLY DISPLAYING TORQUE OF TORQUE WRENCH HAVING A PRESET MAXIMUM TORQUE

(75) Inventors: Ming-Hua Li, Taichung (TW); Li-Hsia Lin, Taichung (TW); Mei-Chin Chou, Taiping (TW)

(73) Assignee: Industrial Technology Research Institute, Hsinchu (TW)

( * ) Notice: Subject to any disclaimer, the term of this patent is extended or adjusted under 35 U.S.C. 154(b) by 92 days.

(21) Appl. No.: 10/759,552

(22) Filed: Jan. 16, 2004

(65) Prior Publication Data

US 2005/0155469 A1 Jul. 21, 2005

(51) Int. Cl.

| | |
|---|---|
| ***B25B 23/144*** | (2006.01) |
| ***B25B 23/159*** | (2006.01) |
| ***B25B 23/142*** | (2006.01) |
| ***B25B 23/157*** | (2006.01) |
| ***B25B 23/14*** | (2006.01) |

(52) U.S. Cl. ..... 81/479; 81/478; 81/483; 81/474; 81/475; 81/476; 81/467

(58) Field of Classification Search ..... 81/479, 81/478, 483, 474–476, 467

See application file for complete search history.

(56) References Cited

U.S. PATENT DOCUMENTS

| | | | | |
|---|---|---|---|---|
| 4,641,538 | A * | 2/1987 | Heyraud | 73/862.26 |
| 5,537,877 | A * | 7/1996 | Hsu | 73/862.23 |
| 5,890,406 | A * | 4/1999 | Thorn | 81/468 |
| 6,276,243 | B1 * | 8/2001 | Jenkins | 81/479 |

lp;1p* cited by examiner

*Primary Examiner*—Joseph J. Hail, III
*Assistant Examiner*—Bryan Muller
(74) *Attorney, Agent, or Firm*—W. Wayne Liauh

(57) ABSTRACT

Disclosed is a torque wrench comprising a signal generator including a spring biased against a trigger member, a sensor, and a disc biased between the spring and the sensor, a setting assembly including a cylindrical member for receiving the disc and the sensor, a cap, a knob through the cap to threadably couple to the cylindrical member, and a sliding pin inserted through a groove on a handle into the cylindrical member for coupling, and a numeric display mounted around the handle. A maximum torque of the wrench can be preset by rotating the knob and shown on the display. Also, an amount of torque being exerted by wrench can be shown on the display. The wrench may trip when the amount of torque has reached the preset maximum torque.

8 Claims, 9 Drawing Sheets

A

DEVICE FOR NUMERICALLY DISPLAYING TORQUE OF TORQUE WRENCH HAVING A PRESET MAXIMUM TORQUE

BACKGROUND OF THE INVENTION

1. Field of the Invention

The present invention relates to torque wrenches and more particularly to such a torque wrench having a numeric display for displaying a preset maximum torque and an amount of torque being exerted so that the wrench may stop tightening a thing (e.g., bolt, nut, etc.) automatically when the amount of torque has reached the preset maximum torque.

2. Description of Related Art

Torque wrenches are well known. For example, a prior torque wrench is shown in FIG. 1. The wrench comprises an elongated, hollow handle 1, an enclosed box portion 2 at a forward end of the handle 1, the enclosed box portion 2 including a head 2*a* and an elongate bar 2*b* extended into the handle 1, a trigger member 3 at a rear end of the bar 2*b*, a spring 4 having a forward end biased against a rear end of the trigger member 3, a rod 5 having a forward end biased by a rear end of the spring 4, and a rotatable cap 6 having internal threads adapted to secure to an externally threaded section at a rear end of the handle 1. A maximum torque can be set as indicated on a dial by rotating the cap 6 about the handle 1. Also, the rod 5 moves forward to compress the spring 4 which in turn pushes the trigger member 3 to engage with the rear end of the bar 2*b*. In use, the trigger member 3 may trip (i.e., the bar 2*b* is disengaged from the trigger member 3) immediately with an audible click being produced when the amount of torque being exerted by the wrench has reached the preset maximum torque. However, such mechanism has the drawbacks of being low in precision and trouble prone.

A Taiwanese Patent Published No. 84,211,488 disclosed an electronic torque wrench as shown in FIGS. 2 and 3. The wrench comprises an elongated, hollow handle 7, an enclosed box portion 8 at a forward end of the handle 7, the enclosed box portion 8 including a head 8*a* and an elongate bar 8*b* extended into the handle 7, a trigger member 9 at a rear end of the bar 8*b*, a spring 10 having a forward end biased against a rear end of the trigger member 9, a rod 11 having a forward end biased by a rear end of the spring 10, a sleeve 14 having an internally threaded section at a rear end of the handle 7, a rotatable cap 13 including a hollow barrel 12 having external threads inserted through the sleeve 14 into the rod 11 so as to threadedly secure the barrel 12 and the sleeve 14 together, and a torque measurement device 5 mounted on a rear portion of the handle 7, the torque measurement device 5 including a conversion circuit, a sensor formed of variable resistor, the sensor having a sliding member 16 inserted through an elongate groove 7*a* of the handle 7 into the rod for coupling, and a numeric display. A maximum torque can be set as detailed below. Rotate the cap 13 about the handle 7 to threadedly advance the barrel 12 for pushing the rod 11 and thus the sliding member 16 forward. Also, the spring 10 is compressed. And in turn the trigger member 9 is pushed by the spring 10 to engage with the rear end of the bar 8*b*. Electrical resistance of the sensor is thus changed as the sliding member 16 moves. Eventually, the preset maximum torque is shown numerically on the display after converting the electrical resistance change into digital signal by the conversion circuit. Likewise, in use the trigger member 9 may trip when the amount of torque being exerted by the wrench has reached the preset maximum torque. However, such mechanism still has the drawbacks of having complicated components and poor precision if the movement of the sliding member 16 is not smooth, elasticity of the spring 10 is fatigued, or a contact between the trigger member 9 and the rear end of the bar 8*b* is loosened. Above drawbacks may compromise the desired effect of automatically tripping the trigger member 9 when the amount of torque being exerted by the wrench has reached the preset maximum torque. This is because the amount of torque being exerted by the wrench may be not equal to the preset maximum torque (i.e., it changed) when the automatic trip occurs. Thus, the need for improvement still exists.

SUMMARY OF THE INVENTION

It is an object of the present invention to provide a torque wrench having a preset maximum torque, the torque wrench including a hollow, cylindrical handle, an enclosed box portion at a forward end of the handle, a torque measurement assembly at a rear end of the handle and being releasably coupled to a rear end of the enclosed box portion, and a numeric display device for receiving signals output from the torque measurement assembly, the torque measurement assembly comprising a trigger member mounted in the handle, the trigger member having a front end releasably coupled to the rear end of the enclosed box portion; a signal generator including a forward end coupled to a rear end of the trigger member, the signal generator being adapted to generate signals and transmit the signals to the display device; and a setting assembly mounted at the rear end of the handle, the setting assembly having a forward end coupled to the signal generator, the setting assembly being adapted to move in the handle for pushing the signal generator. By utilizing the present invention, both an amount of torque being exerted by the wrench and the preset maximum torque can be shown on the display device.

The above and other objects, features and advantages of the present invention will become apparent from the following detailed description taken with the accompanying drawings.

DETAILED DESCRIPTION OF THE PREFERRED EMBODIMENTS

Figure 1:
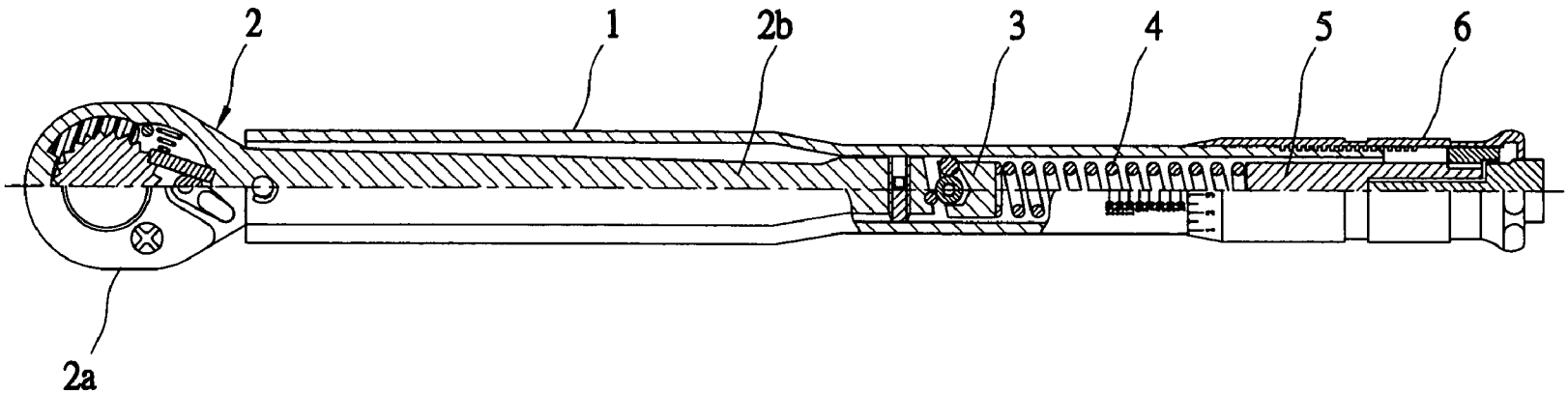
FIG. 1 PRIOR ART
FIG. 1 is a perspective view in part section of a conventional torque wrench.
Figure 2:
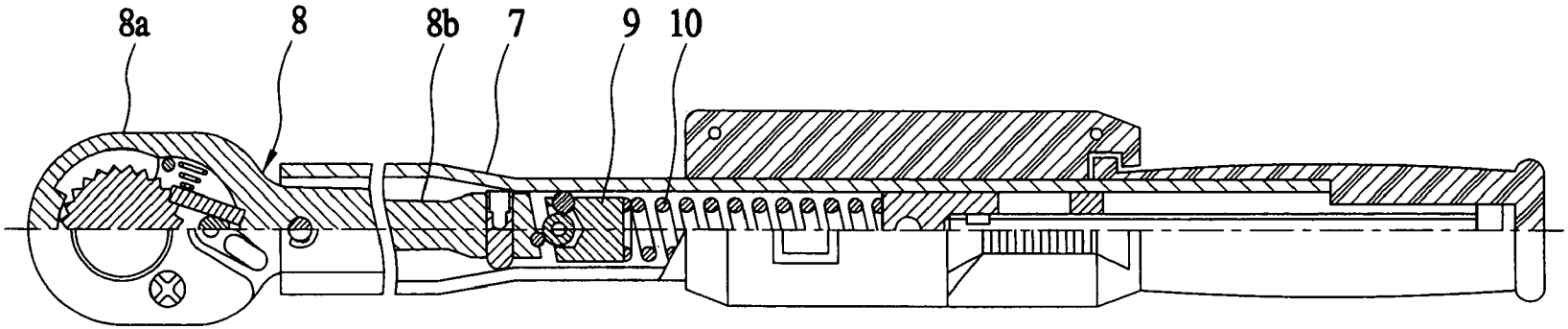
FIG. 2 PRIOR ART
FIGS. 2 and 3 are perspective views in part section of a conventional electronic torque wrench.
Figure 3:
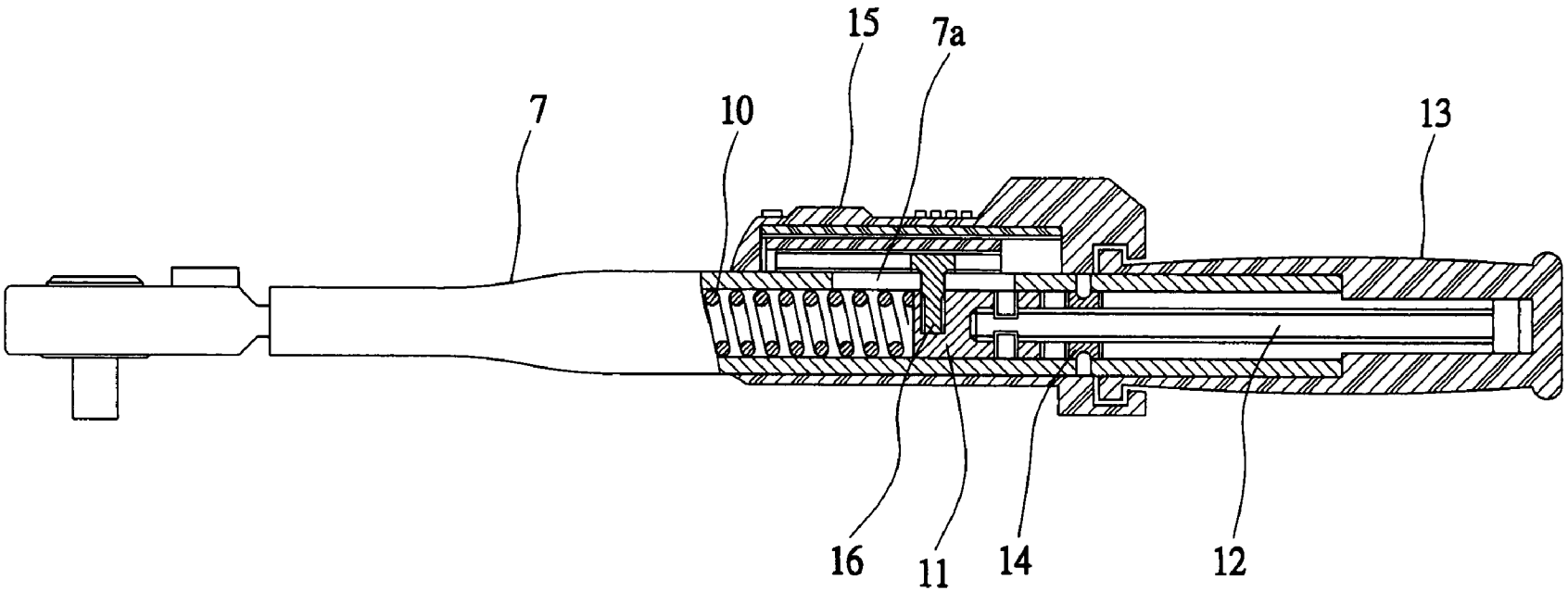
FIG. 3 PRIOR ART
Figure 4:
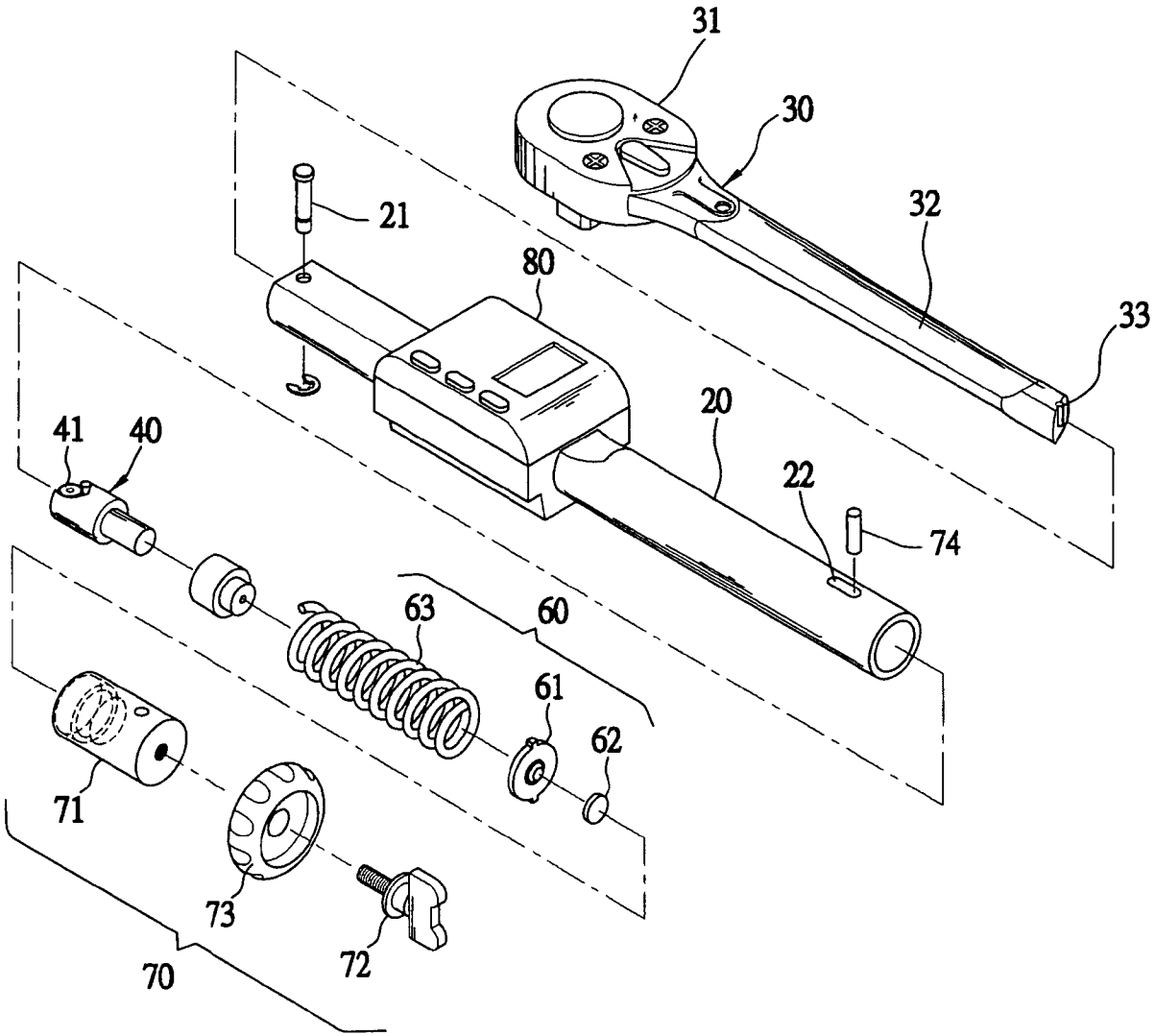
FIG. 4 is an exploded view of a preferred embodiment of torque wrench according to the invention.
Figure 5:
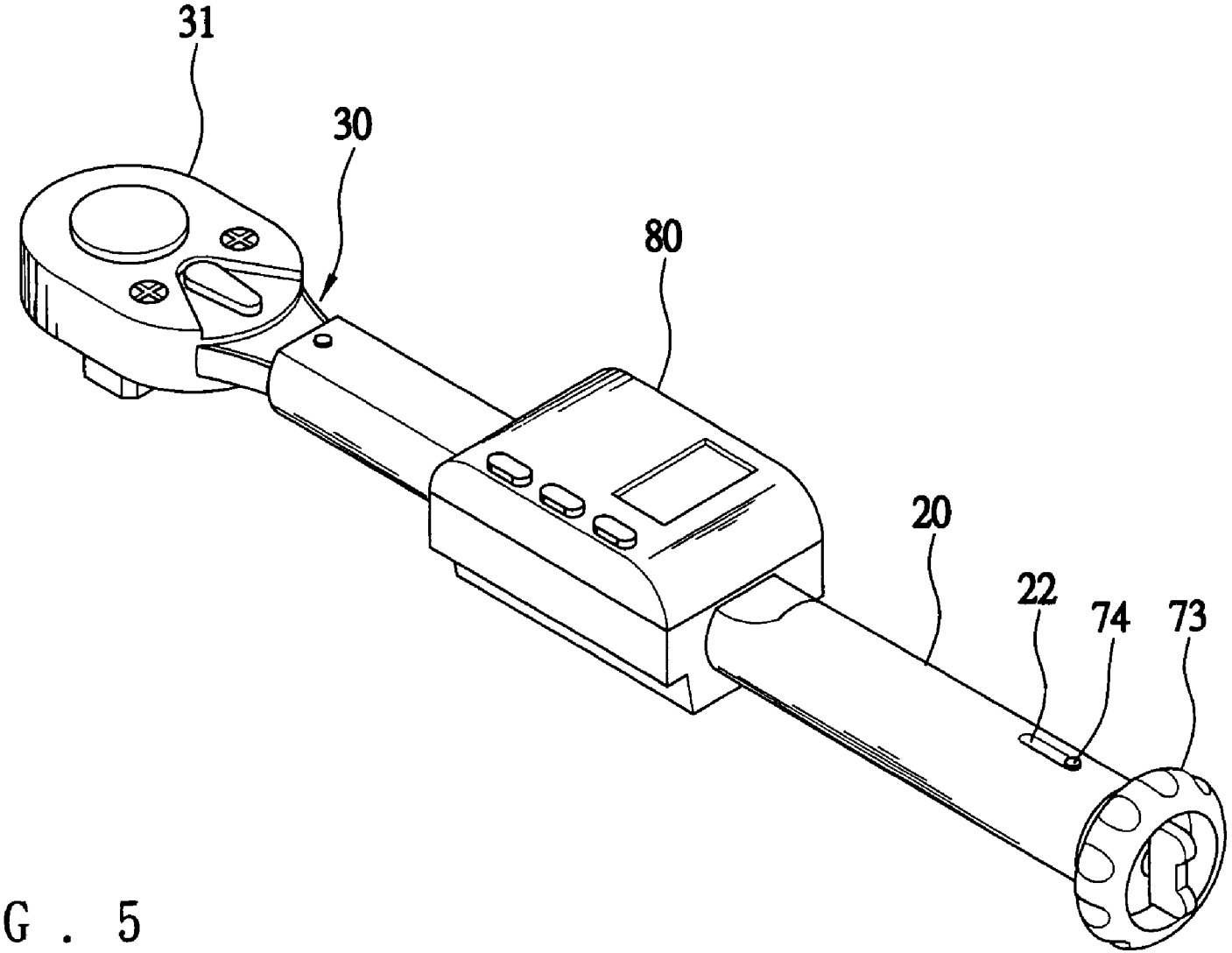
FIG. 5 is a perspective view of the assembled torque wrench according to the invention.
Figure 6:
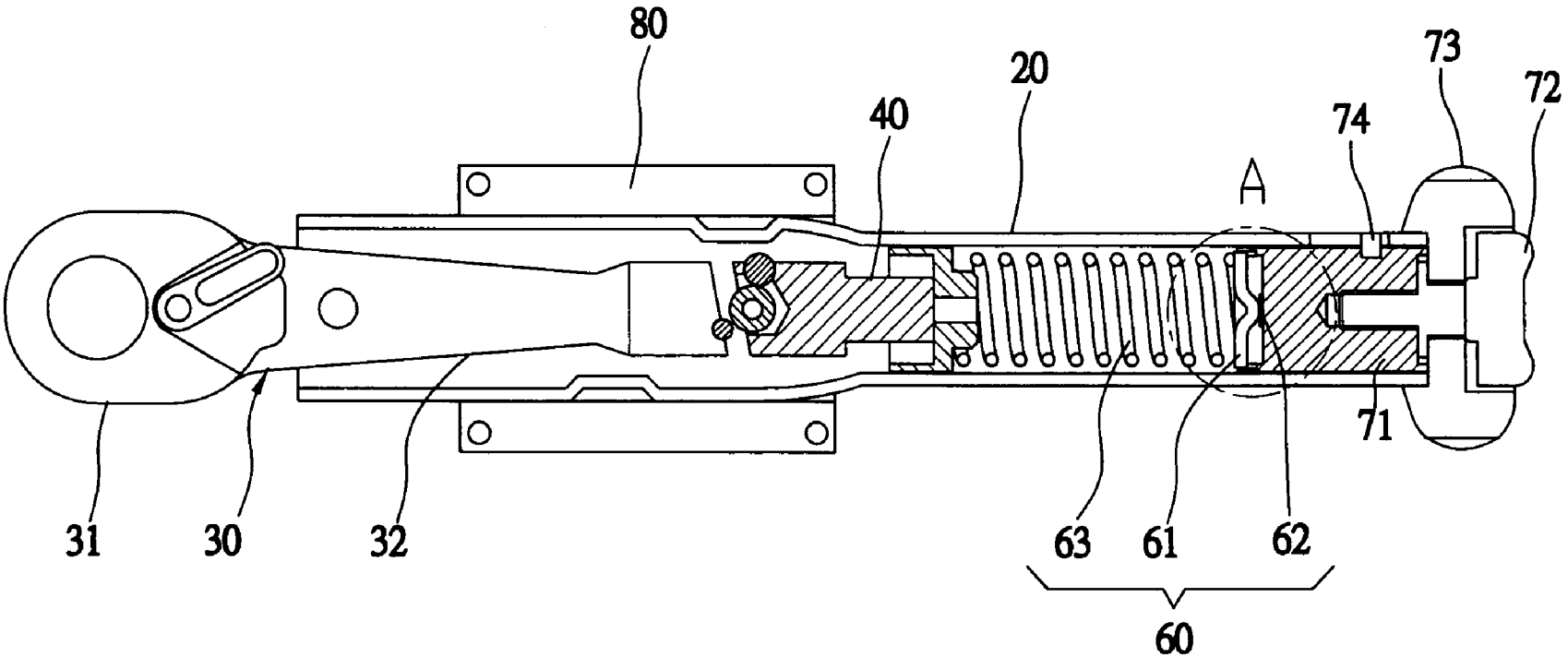
FIG. 6 is a side view in part section of the wrench shown in FIG. 5.
Figure 7:
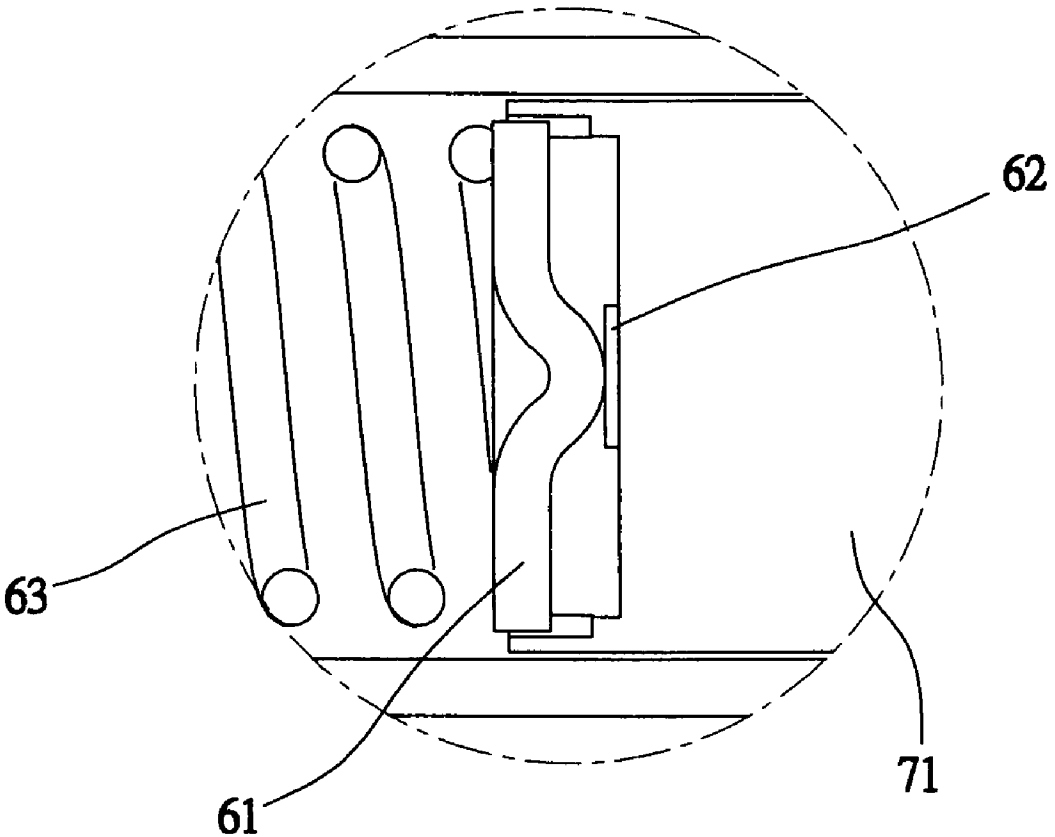
FIG. 7 is a detailed view of the area in circle A in FIG. 6.

Referring to FIGS. 4 to 7, a torque wrench constructed in accordance with the invention is shown. The wrench comprises a hollow, cylindrical handle 20 including an elongated groove 22 adjacent a rear end, an enclosed box portion 30 at a forward end of the handle 20, the enclosed box portion 30 being releasably coupled to the handle 20 by driving a pin 21 through both apertures of the enclosed box portion 30 and the handle 20 to be fastened by a clip, the enclosed box portion 30 including a head 31, an elongate bar 32 extended into the handle 20, and an extension 33 at a rear end of the bar 32, a trigger member 40 including a top roller 41 at a front end in contact with the extension 33, a signal generator 60 including a forward spring 63 having a forward end biased against a rear end of the trigger member 40, a rear sensor 62, and an intermediate disc 61 having a forward side engaged with the spring 63 and a raised central portion at a rear side engaged with the sensor 62 wherein an engagement area is substantially equal to a front surface of the sensor 62, a setting assembly 70 including a forward cylindrical member 71 having a forward barrel for receiving the disc 61 and the sensor 62, a rear central hole, and a top hole, a circular cap 73 having a central aperture, a knob 72 having an externally threaded shank inserted through the central aperture of the cap 73 into the central hole of the cylindrical member 71 for mounting the cap 73 at the rear end of the handle 20, and a sliding pin 74 inserted through the groove 22 into the top hole of the cylindrical member 71 for coupling therewith, and a display unit 80 mounted around a central portion of the handle 20, the display unit 80 including a control circuit, a push button, a power switch, a battery compartment, and a numeric display. A torque measurement assembly of the invention is thus comprised of the trigger member 40, the signal generator 60, and the setting assembly 70. Note that a clockwise rotation of the knob 72 can advance the cylindrical member 71 until the sliding pin 74 is stopped by a forward end of the groove 22. To the contrary, a counterclockwise rotation of the knob 72 can move the cylindrical member 71 backward until the sliding pin 74 is stopped by a rear end of the groove 22. That is, the length of the groove 22 is the travel distance of the cylindrical member 71 within the handle 20.

Figure 8:
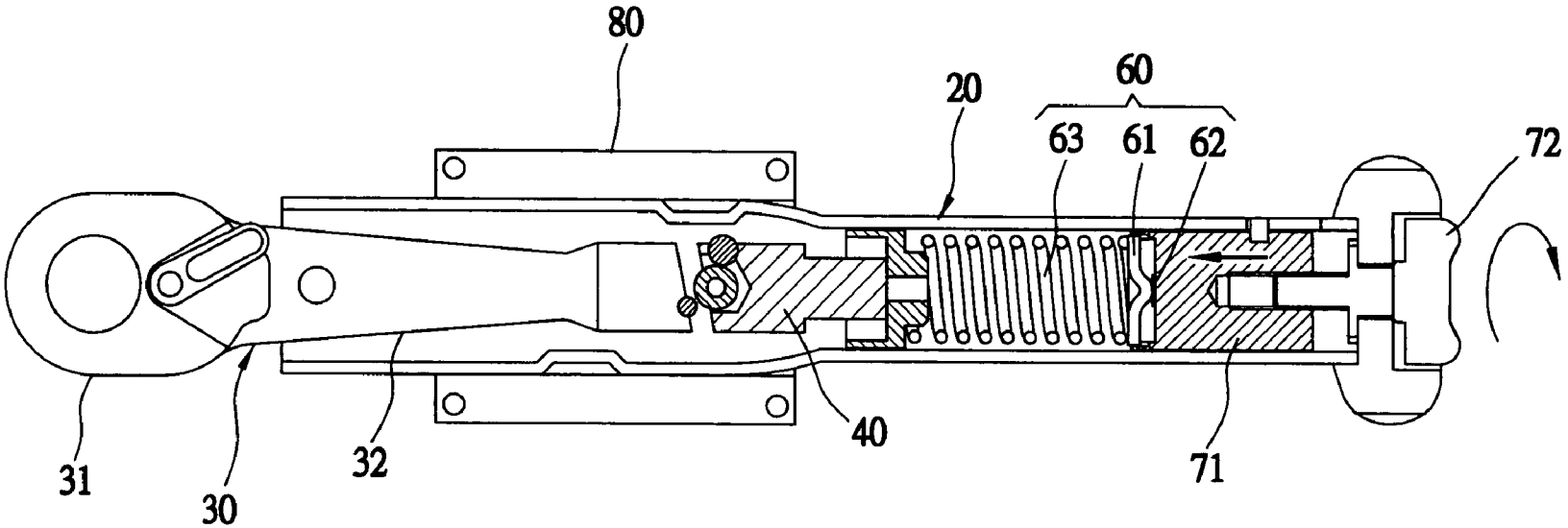
FIG. 8 is a view similar to FIG. 6, where knob is being rotated to set a maximum torque.

Referring to FIG. 8, the setting of a maximum torque of the wrench will now be described in detail below. Rotate the knob 72 to advance the cylindrical member 71 and thus the sensor 62 and the disc 61. The spring 63 is compressed against the trigger member 40 which is not allowed to move forward anymore at this position. Hence, a reaction will impart from the trigger member 40 to the sensor 62 via the spring 63 and the disc 61. A signal (e.g., current) is generated in the sensor 62 in response. The current is then sent to the display unit 80 prior to being converted into a numeric representation and shown on the display. A user can be aware that the maximum torque has been set when a further rotation of the knob 72 (i.e., a forward movement of the cylindrical member 71) is stopped. The torque reading (i.e., the preset maximum torque) is correct. Also, the contact area between the disc 61 and the sensor 62 is sufficient to impart force to the sensor 62 for generating current therein.

Figure 9:
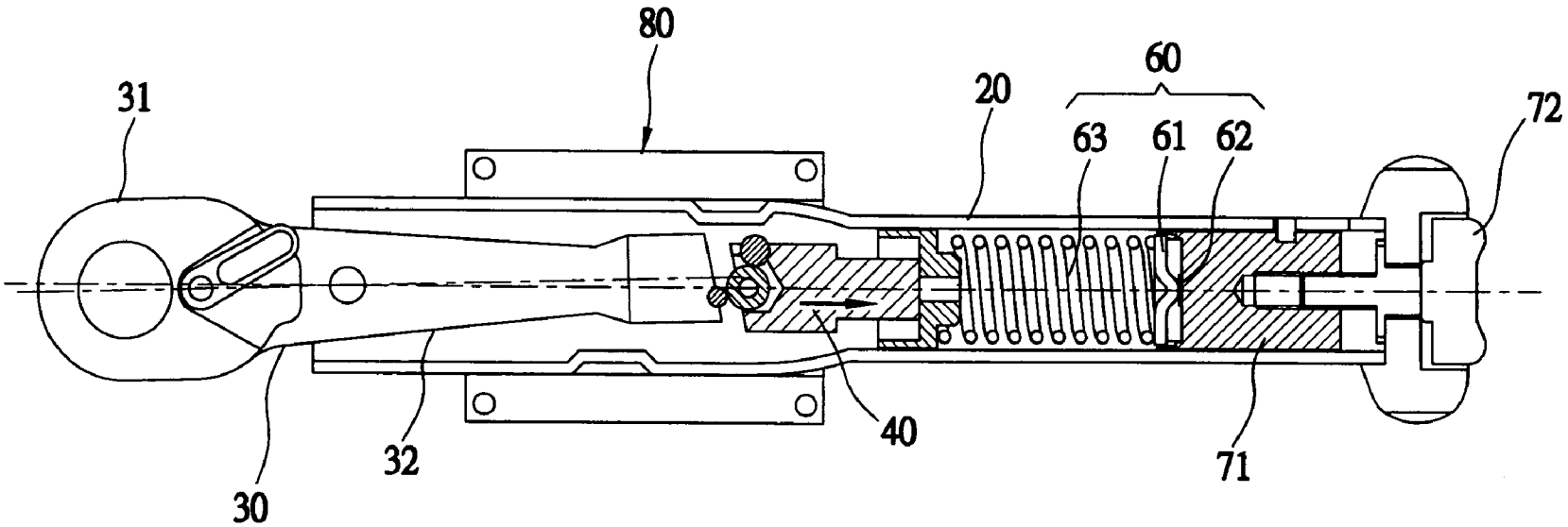
FIG. 9 is a view similar to FIG. 6, where trigger member trips responsive to an amount of torque exerted by the wrench reaching the preset maximum torque.

Referring to FIG. 9, an operation of the invention will now be described in detail below. In a case of a user used the enclosed box portion 30 to hold a bolt and gradually tighten it, the trigger member 40 may trip (i.e., the roller 41 moves rearward to disengage from the extension 33) immediately and current is generated in the sensor 62 as compression force of the spring 63 is imparted to the sensor 62 via the disc 61 when an amount of torque being exerted by the wrench (as shown on the display) has reached the preset maximum torque (also as shown on the display). Note that the cylindrical member 71 is fixed at this process. The user can determine that the actual maximum torque is correct if the actual maximum torque is equal to the preset maximum torque by comparison. Further, the user can be aware that one or more components are malfunctioned if the actual maximum torque is not equal to the preset maximum torque.

While the invention herein disclosed has been described by means of specific embodiments, numerous modifications and variations could be made thereto by those skilled in the art without departing from the scope and spirit of the invention set forth in the claims.

What is claimed is:

1. A torque wrench having a preset maximum torque, the torque wrench including a hollow, cylindrical handle, an enclosed box portion at a forward end of the handle, a torque measurement assembly at a rear end of the handle and being releasably coupled to a rear end of the enclosed box portion, and a numeric display device for receiving signals output from the torque measurement assembly, the torque measurement assembly comprising:

a trigger member mounted in the handle, the trigger member having a front end releasably coupled to the rear end of the enclosed box portion;

a signal generator including a forward end coupled to a rear end of the trigger member, the signal generator being adapted to generate signals and transmit the signals to the display device; and a setting assembly mounted at the rear end of the handle, the setting assembly having a forward end coupled to the signal generator, the setting assembly being adapted to move in the handle for pushing the signal generator;

wherein the signal generator comprises a forward resilient means having a forward end biased against the trigger member, a rear sensor, and an intermediate disc having a forward side engaged with the resilient means and a rear side engaged with the sensor so that the sensor is adapted to generate signals in response to compressing or expanding the resilient means;

further wherein the disc comprises a raised central portion at the rear side engaged with the sensor, the engagement area being substantially the same as a front surface of the sensor.

2. The torque wrench of claim 1, wherein the torque measurement assembly is adapted to receive signals output from the enclosed box portion and transmit the signals to the display device so that the display device is adapted to numerically display an amount of torque being exerted by the wrench responsive to the enclosed box portion being operative to hold and turn an article.

3. The torque wrench of claim 1, wherein the torque measurement assembly is adapted to receive signals output from the enclosed box portion and transmit the signals to the display device so that the display device is adapted to numerically display an amount of torque being exerted by the wrench when the enclosed box portion trips while operating.

4. The torque wrench of claim 1, wherein the torque measurement assembly is adapted to turn for generating signals representing a preset maximum torque and transmitting the signals to the display device so that the display device is adapted to numerically display the preset maximum torque when tripping.

5. The torque wrench of claim 1, wherein the enclosed box portion comprises an extension at a rear end, and the trigger member comprises a roller at a front end being in contact with the extension.

6. The torque wrench of claim 1, wherein the resilient means is a spring.

7. The torque wrench of claim 1, wherein the setting assembly comprises a forward cylindrical member having a forward barrel for receiving a sensor of the signal generator, a rear knob threadedly secured to the cylindrical member, a sliding pin inserted through an elongated groove on the handle, into the cylindrical member for coupling therewith, and a cap interconnected to the cylindrical member and the knob so that turning the knob will advance the cylindrical member to push the signal generator until being stopped by the sliding pin.

8. The torque wrench of claim 1, wherein the signals generated by the signal generator and transmitted to the display device are either voltage signals or current signals.

* * * * *